US010538886B2

(12) United States Patent
Buschmann et al.

(10) Patent No.: US 10,538,886 B2
(45) Date of Patent: Jan. 21, 2020

(54) ROAD PAVER WITH HEATING ELEMENT FOR A SCREED

(71) Applicant: JOSEPH VOEGELE AG, Ludwigshafen/Rhein (DE)

(72) Inventors: Martin Buschmann, Neustadt (DE); Ralf Weiser, Ladenburg (DE); Roman Munz, Neustadt (DE); Christian Pawlik, Neustadt (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 0 days.

(21) Appl. No.: 15/938,795

(22) Filed: Mar. 28, 2018

(65) Prior Publication Data

US 2018/0282952 A1 Oct. 4, 2018

(30) Foreign Application Priority Data

Mar. 29, 2017 (EP) ..... 17163614

(51) Int. Cl.
*E01C 23/14* (2006.01)
*E01C 19/42* (2006.01)
*E01C 19/48* (2006.01)

(52) U.S. Cl.
CPC ..... *E01C 19/42* (2013.01); *E01C 19/48* (2013.01); *E01C 23/14* (2013.01); *E01C 2301/10* (2013.01); *E01C 2301/14* (2013.01)

(58) Field of Classification Search
CPC ... E01C 23/14; E01C 2301/10; E01C 2301/14
(Continued)

(56) References Cited

U.S. PATENT DOCUMENTS 4,781,491 A * 11/1988 Chiba ..... E01C 23/14 126/271.2 A
5,908,459 A * 6/1999 Rower ..... E01C 19/48 404/84.1

(Continued)

FOREIGN PATENT DOCUMENTS

EP 1 295 990 A2 3/2003
EP 1 036 883 B1 7/2004

(Continued)

OTHER PUBLICATIONS

European Search Report dated Jan. 5, 2016, Application No. 15179644.8—Applicant Joseph Voegele AG, 8 Pages.

(Continued)

*Primary Examiner* — Gary S Hartmann
(74) *Attorney, Agent, or Firm* — Brooks Kushman P.C.

(57) ABSTRACT

A road paver comprises a generator, a control device and a screed, the screed comprising a basic screed and being suited to be modified, by selectively attaching or detaching broadening parts, from a first to at least a second, different screed configuration. The basic screed and the broadening parts each comprise one compacting unit and one electric heating element to be supplied with power from the generator for heating the compacting unit to prevent the laying material from adhering to the compacting unit and to finish a high-quality road pavement. The control device is configured to individually switch on or off each one of the two resistance wire windings of the heating element of the basic screed depending on the screed configuration determined by the control device to distribute electrical power generated by the generator to the individual resistance wire windings.

20 Claims, 5 Drawing Sheets

(58) Field of Classification Search
USPC ..... 404/95
See application file for complete search history.

(56) References Cited

U.S. PATENT DOCUMENTS

| | | | | |
|---|---|---|---|---|
| 6,318,928 | B1 | 11/2001 | Swearingen | |
| 6,334,735 | B1 * | 1/2002 | Williams | E01C 19/48 404/79 |
| 6,421,594 | B1 | 7/2002 | Erasmus | |
| 6,433,735 | B1 * | 8/2002 | Bloebaum | G01S 19/06 342/357.43 |
| 7,217,062 | B2 * | 5/2007 | Pisano | E01C 19/48 404/77 |
| 7,641,419 | B1 * | 1/2010 | Nelson | E01C 19/48 404/84.05 |
| 7,993,075 | B2 * | 8/2011 | Nelson | E01C 19/48 404/77 |
| 8,356,957 | B2 | 1/2013 | Weiser | |
| 8,568,058 | B2 * | 10/2013 | Smieja | E01C 19/48 404/118 |
| 8,961,064 | B2 | 2/2015 | Ramos et al. | |
| 9,234,931 | B2 * | 1/2016 | Lindsey | E01C 19/22 |
| 9,719,216 | B2 | 8/2017 | Buschmann | |
| 2005/0167417 | A1 | 8/2005 | Buschmann | |
| 2009/0090237 | A1 | 4/2009 | Nishikawa et al. | |
| 2010/0256878 | A1 | 10/2010 | Zegowitz | |
| 2012/0087726 | A1 | 4/2012 | Smieja | |
| 2014/0186115 | A1 | 7/2014 | Graham et al. | |
| 2014/0294503 | A1 | 10/2014 | Ramos et al. | |
| 2014/0363230 | A1 | 12/2014 | Buschmann et al. | |
| 2015/0361626 | A1 | 12/2015 | Trox et al. | |
| 2016/0185164 | A1 | 6/2016 | Thiesse | |
| 2016/0289902 | A1 | 10/2016 | Eul et al. | |
| 2017/0037585 | A1 * | 2/2017 | Buschmann | B60W 40/13 |

FOREIGN PATENT DOCUMENTS

| | | | |
|---|---|---|---|
| EP | 1 566 484 | A1 | 8/2005 |
| EP | 1 555 348 | B1 | 10/2008 |
| EP | 2 239 374 | A1 | 10/2010 |
| EP | 2 366 830 | A1 | 9/2011 |
| EP | 2 439 333 | A2 | 4/2012 |
| EP | 2 813 619 | A1 | 12/2014 |
| EP | 3 075 909 | A1 | 10/2016 |
| JP | 11-245137 | A | 9/1999 |
| JP | 2003-519733 | A | 6/2003 |
| JP | 2008-032174 | A | 2/2008 |
| JP | 2009-085884 | A | 4/2009 |
| JP | 2011-204236 | A | 10/2011 |
| JP | 2014-240594 | A | 12/2014 |
| JP | 2015-094132 | A | 5/2015 |
| JP | 2016-191299 | A | 11/2016 |
| JP | 2017-031798 | A | 2/2017 |
| WO | 2011/135846 | A1 | 11/2011 |
| WO | 2014/124545 | A1 | 8/2014 |

OTHER PUBLICATIONS

European Search Report dated Sep. 19, 2017, Application No. 17163614.5-1614—Applicant Joseph Voegele AG, 8 Pages.

Japanese Office Action dated May 23, 2017, Application No. 2016-152398, 4 Pages.

Japanese Search Report dated Feb. 12, 2019, Application No. 2018-044006, 17 Pages.

Japanese Office Action dated Mar. 29, 2019, Application No. 2018-044006, 3 Pages.

* cited by examiner

ROAD PAVER WITH HEATING ELEMENT FOR A SCREED

CROSS-REFERENCE TO RELATED APPLICATIONS

This application claims foreign priority benefits under 35 U.S.C. § 119(a)-(d) to German patent application number EP 17163614.5, filed Mar. 29, 2017, which is incorporated by reference in its entirety.

TECHNICAL FIELD

The present disclosure relates to a road paver with a heating element for a screed.

BACKGROUND

It is well-known in road pavers to electrically heat the screed with the compacting units, such as tampers, screed plates and pressure bars. These components must be heated to prevent the also heated laying material from adhering to the components. The temperature of the laying material is, in the working state, about 160-185° C. Therefore, heating elements with resistance wire windings are attached to the screed of the road paver and preheat the screed to the required operating temperature prior to the laying operation and maintain the same during the laying operation. The heating elements are here normally supplied with power and voltage by a generator driven by a primary drive, usually a diesel engine. To limit the power input or energy consumption of the screed heating, it is known to operate individual heating elements of different screed segments in a clocked manner, i.e., alternatingly, as is described, for example, in EP 1 036 883 B1. As is shown in EP 1 295 990 A2, the clocking can also take into consideration the temperature of the screed segments. From EP 1 555 348 B1, heating elements comprising a plurality of heating spirals or heating wire windings are moreover known, wherein the heating power of each one of the heating spirals corresponds to the rated heating power of the heating element, thus providing a redundancy in case of a failure of a heating spiral. Moreover, a generator can provide variable electric power due to different engine speeds, as is described in WO 2014/124545 A1.

The above-mentioned variants, however, involve deficiencies in operating the heating elements and the generator with an optimal efficiency and simultaneously optimally utilising the performance of the existing components. In particular during the heating phase of the screed, the demands on the generator and heating elements are different from those during the laying operation. Moreover, screeds in different configurations are known. Apart from road pavers with screeds having a fixed working width, road pavers with screeds of variable working widths are also known. Such screeds usually comprise a basic screed of a fixed size, the dimensions of which may be modified by selectively attaching or detaching broadening parts to be able to provide the respective desired road width. This change of the size also requires adjusting the heating power of the screed heating. U.S. Pat. No. 8,961,064 B2 describes a heating system for a screed with a recognition of the attached broadening parts. Finally, EP 3 075 909 A1 discloses a road making machine with a network in which a portion of a power line is used for data transmission.

SUMMARY

An object of the present disclosure is to eliminate the mentioned problems and to provide a road paver with a screed which optimally utilizes the generator and line capacity by its design and control system.

According to the disclosure, this object is achieved by a road paver with a heating element for a screed, and a method for heating compacting units of a screed of a road paver.

According to an aspect of the present disclosure, a road paver comprises, besides other elements, a generator, a control device and a screed, the screed comprising compacting units, such as tampers, screed plates and pressure bars, and at least one electric heating element that may be supplied with power from the generator for heating the compacting units. The screed, which is preferably mounted to a tractor of the road paver so as to be exchangeable, comprises at least one basic screed and is suited to be modified from a first to at least a second, different screed configuration by selectively attaching or detaching broadening parts which may be detachable supplementary elements of a fixed length or movable telescopic elements. In this way, left and right telescopic elements which are already connected to the basic screed can be extended to obtain a larger working width. The broadening parts, however, may also be present in modifications which are attached and fixed to the basic screed and/or to telescopic elements to broaden the screed. Moreover, broadening may also be effected by several telescopic elements and/or supplementary elements per side, and these may be fixed to each other and/or to the basic screed.

The heating element is embodied as an electric resistance heating element and comprises at least two resistance wire windings insulated from each other in terms of power and voltage which can be individually switched on or off, controlled by the control device. The control device is configured such that it causes the switching of the resistance wire windings depending on a previously determined screed configuration to distribute electrical power generated by the generator to the individual resistance wire windings. Here, in particular the configuration, i.e., the type, size and construction of the screed, is determined to individually switch, at least on the basic screed, the resistance wire windings of the one or the several heating elements. Thus, the electrical power provided by the generator can be distributed to the individual resistance wire windings already on the basic screed.

This offers the advantage that the heating of the compacting units may be designed very homogenously, depending on the arrangement of the resistance wire windings, thus also reducing undesired heat losses and increasing the efficiency. This does not only reduce the operating costs, but also increases the working and production quality. Since individual resistance wire windings may be operated in combination with each other and may be, moreover, arranged to be adapted to the screed's geometry, the individual resistance wire winding may be dimensioned for a narrower heating power range, i.e., a range of electrical power, which on the one hand prevents a low effectivity when low electrical power is supplied, and on the other hand prevents material weakening at a high electrical power.

In an advantageous modification, the heating element is designed modularly with its two or more resistance wire windings and is removably attached to the screed or the compacting units. This permits an easy handling of the heating element in case of required repair works or replacements. Thus, operation may be continued with a spare heating element if a heating element needs to be repaired. Moreover, the use of different alternative heating elements with different power inputs is conceivable to change to different operational conditions, for example to summer or winter operation.

In a typical modification, the control device is configured to individually switch on or off each of the resistance wire windings of the broadening parts depending on the screed configuration. If the screed configuration, that is the size and type of the basic screed and, if present, the broadening parts, has been determined by the control device at the beginning of the operation, it switches the resistance wire windings of the heating elements of broadening parts, as on the basic screed, individually and depending on the desired heating characteristic. Thus, for all components of the screed, an effective heating adapted to the operating parameters may be effected.

It would be particularly advantageous to dimension the resistance wire windings of a heating element in the sense of a main winding and an additional winding for different performance ranges. Thus, the main winding may be designed, for example, for two thirds, and the additional winding may be designed for one third of the altogether possible heating power. This permits an operation of the heating element in four stages, i.e., zero, one third, two thirds and three thirds of the total power. Thus, heating power stages that are already different due to their design may be provided and further varied by means of additional parameters as will be described below. By such a design, the specific heating power, i.e., the heating power per area, may be particularly suitably varied. The design-related planning of different heating power zones permits to adjust the property of the resistance wire, for example the diameter of the wire, to ensure a heating operation with a preferably high efficiency and low material stress.

Preferably, the control device is configured to automatically determine the screed configuration. The control device, which may be implemented as a microcomputer with corresponding software, is programmed such that, at the beginning of the operation, for example when the road paver or the operating panel is switched on, all required information concerning the setup of the screed can be automatically retrieved and considered for the control of the screed heating. The control device initially requests e.g., the data supply channels and obtains the type-information of all existing screed components. Here, the components may be connected to the control device either via cable and a corresponding plug-in connection or via radio communication. The actual identification of the individual screed components may be effected in most diverse ways. For example, weight sensors which are connected with the control device may be used to determine the screed configuration, or the screed components may be provided with specific ID tags (identification codes) which are read out. The data acquired in each case are then in particular compared with a database stored in the control device which may be updated by a PC interface. The automatic recognition of the screed configuration provides a clear saving of time for the machine operator since no manual input is required. Only the desired heating program must be optionally set. By means of additional sensors, for example ambient temperature or screed temperature sensors, additional information relevant for the operation of the screed heating may be collected, and based on them, the control device may calculate heating programs and suggest them to the user.

In a common modification, the road paver has a Power Line Communication (PLC) base module, and the screed has one or several PLC modules which are configured and connected to communicate via the existing power lines. Here, the control device and/or the PLC base module are configured to detect the design of the screed by evaluation of the PLC modules by PLC data transmission. As is well-known from other applications, in PLC data transmission, the data signal is additionally modulated, via a carrier frequency, to the power line to the heating elements operated at e.g., 230V or 400V. The PLC base module and the PLC modules are attached and connected to couple the signals in and out and to forward control commands. PLC data transmission is a robust transmission technique and reduces the demand for further control lines. This reduces manufacturing efforts and thus manufacturing costs and possibly required repair works. If the PLC modules which are arranged on the screed also serve as storage units for information concerning the type and construction of the screed, further electronic components may be effectively omitted.

In an advantageous modification, each resistance wire winding of the heating element is switched on and off by a switching relay. As was described in the previous paragraph, the signal transmission by PLC is a particularly advantageous variation also for construction machines. For example, the switching of the resistance wire windings, i.e., the control of a switching relay, may also be effected in this manner. This design offers a robust and reliable control and also the possibility of implementing future technical extensions.

In a further modification, the road paver has a switching relay for each resistance wire winding of a heating element for switching on or off the resistance wire winding, the relay being integrated in a heating element monitoring module. Depending on the design of the heating element monitoring module, one of them may be arranged per resistance wire winding. However, one heating element monitoring module may be connected for monitoring several resistance wire windings or several heating elements. Preferably, the control device is furthermore configured and connected to control the switching relay via the power line by PLC. It is suitable to combine the switching functions with the heating element monitoring modules to save space and effectively utilize already existing components.

In a further modification, each switching relay of a heating element is connected to a separate power line and a separate control line. Caused by the control signal which is transmitted to the switching relay, the latter establishes or interrupts a current flow to the resistance wire winding. This permits the use of further signal transmission techniques and the modification of the control line independent of the power supply and vice versa.

Preferably, the components of the screed, that means the basic screed and the broadening parts, may each comprise two or more heating elements, wherein the number of heating elements of one component is independent of the other ones. Each of the heating elements in particular comprises at least two resistance wire windings. This permits to admit different heating powers to different zones of the screed, leading to energy savings if different heat losses occur, for example in the marginal zones compared to central zones. The production of smaller modules is moreover easier and less expensive, which is also true for the replacement or repair in case of a technical defect, and the road finishing operation may also be maintained in the meantime when the remaining heating elements are operated with a higher heating power for compensation. It should be pointed out that statements contained in this text above or below apply both to one and to several heating elements per component.

In a typical modification, the generator is suited to be driven with variable speeds, the performance of the generator being increased with increasing speeds. In response to the speed of the primary drive, usually a diesel engine, the power and voltage supply of the heating elements may thus be adapted to the current heating power demand of the screed. The continuously variable speed control permits, together with the other described adjusting facilities, to exactly adapt the heating power to ambient conditions and the operating mode. By designing the resistance wire windings for certain heating power ranges, the respective resistance wire winding may be supplied with voltage or power at an amount that permits a particularly efficient operation.

In a further advantageous modification, it is possible to preselect an operating mode of the road paver, such as "Eco" or "Power". Thereby, a maximum generator speed or generator power is pre-set. Depending on the operating mode and thus the available generator power, the control device then controls a switching on and off of resistance wire windings. It may thus make sense to select, in a "Power" mode, a maximum speed for which the generator is suited, for example 1500 rpm, to achieve the quickest possible heating of the screed or to compensate unfavourable conditions, for example particularly low ambient temperatures. In another situation, it may be reasonable to operate the screed heating at a lower speed than the maximally possible generator speed and therefore select an "Eco" mode prior to the operation which limits the speed, for example, to 1200 rpm. This can make sense to achieve a lower fuel consumption or noise emission, or because the ambient conditions (e.g., ambient temperature) only require a lower heating power demand.

The maximum generator power depending on the operating mode is determined by the control device and uniformly distributed to the resistance wire windings. The switching of the resistance wire windings is done such that the electrical power is utilized optimally. As an alternative or in combination with the maximum default speed, of course other adjusting facilities well-known to the person skilled in the art can be employed for the operation of an electric generator. For example, the exciting current that creates the magnetic field may be limited. For example, maximum heating powers of, for example, 35 kW, 31 kW or 25 kW may be set. Since the switching on or off of resistance wire windings is relevant for the power consumption of the screed, and the resistance wire windings should be operated within the range of their highest efficiency, the control device is e.g., configured to switch off resistance wire windings if the heating power demand cannot be achieved in the selected mode. It is, of course, suitable to operate not only the screed heating, but also other electric consumers, for example the lighting, control or charging of an on-board battery, also with the electrical power of the same generator, which also serves to supply the screed with heating power. Thus, not the complete electrical power generated by the generator is available for the screed heating, while the distribution of the electrical power to the on-board electronics of the road paver can still be effected by the control device. As an alternative, it is also conceivable to have a second generator or a dynamo be driven by the primary drive to supply the other electric consumers.

Ideally, the control device is configured to vary the heating power of the heating element or the heating elements depending on a pre-set timed program or switching pattern. It may thus be suitable to switch on and off the individual resistance wire windings of a heating element of a left screed segment in a clocked manner, i.e., periodically alternatingly, with the individual resistance wire windings of a heating element of a right screed segment. If the heating power demand is low due to the given conditions, for example ambient temperature, temperature of the laying material, ground temperature, this will result in a low heat dissipation in connection with the heat capacity of the compacting units, thus, the clocking will lead to energy savings. Moreover, this permits a further subdivision of the above-described power stages to e.g., ⅙ steps of the total power.

In a further modification, the control device is configured to adjust, by means of signals of sensors which indicate e.g., the winding temperature, the winding resistance, the speed, or the voltage output of the generator, or other quantities indicating a load of the generator, the heating power of the heating element or several heating elements to prevent an overload of the generator. Thus, for the generator, but also for the resistance wire windings, an automatic protection from damage due to excessive power and voltage supply is given. This is relevant in case of operation errors, faulty programming of the control device or the use of unsuited extension segments. Thus, time-consuming and expensive repairs or replacements of the generator, the heating elements or other components is avoided. Simultaneously, however, the heating system may be designed such that the generator monitored by sensors is temporarily operated with its maximum power output by switching on additional heating elements, which leads to a shortened heating period in particular during the heating phase. The heating system may additionally be designed such that future extensions, e.g., the use of a generator with a higher power or other heating elements, may also be considered electronically.

In the following, exemplified embodiments of the disclosure are described with reference to the attached drawings.

BRIEF DESCRIPTION OF THE DRAWINGS

Corresponding components are always provided with the same reference numerals in the figures.

DETAILED DESCRIPTION

Figure 1:
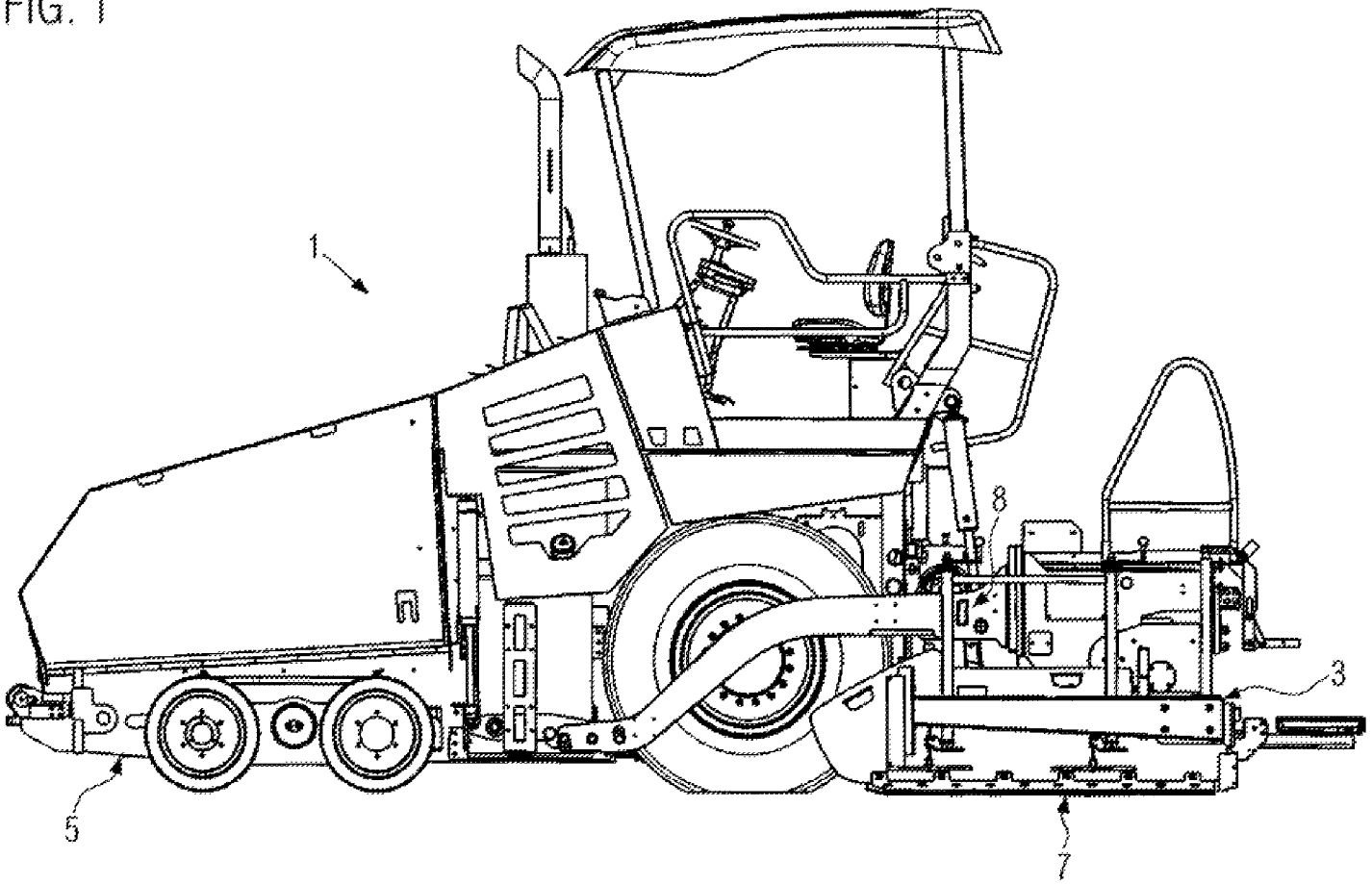
FIG. 1 shows a schematic view of an exemplified embodiment of a road paver with a heatable screed according to the disclosure.

FIG. 1 shows an exemplified embodiment of a road paver 1 according to the disclosure in a schematic view with a heatable screed 3 and a tractor 5. Screeds 3 of different types may be exchangeably attached to the tractor 5 via a fastening mechanism. At the bottom side of the screed 3, there is a compacting unit 7 which turns the laying material into a plane and firm road pavement. A weight sensor 8, which is attached to the suspension of the screed 3 at the tractor 5, may serve to determine the screed configuration by means of known weight values of the different models of the screed 3.

Figure 2:
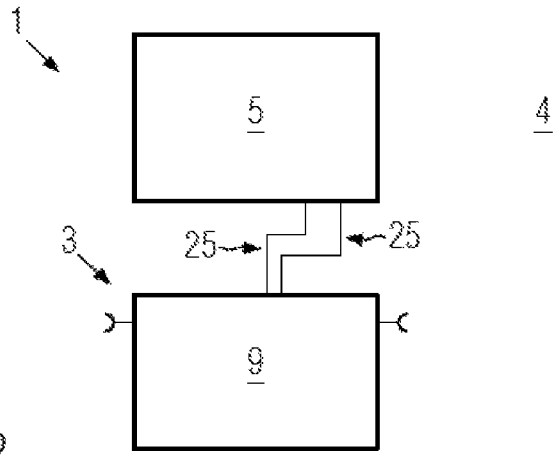
FIG. 2 shows a schematic view of an exemplified embodiment of a road paver with a heatable screed according to the disclosure in a first screed configuration comprising a basic screed.

FIG. 2 shows a schematic view of an exemplified embodiment of a road paver 1 with a heatable screed 3 according to the disclosure in a first screed configuration comprising a basic screed 9. Two power lines 25 lead from the tractor 5 to the basic screed 9 and essentially serve to supply the screed heating with power and are, due to their dual design, already suited for supplying additional broadening parts. Depending on the required electrical power, one single power line 25 would also be possible and sufficient. The shown first screed configuration already has a sufficient width for the desired field of employment.

Figure 3:
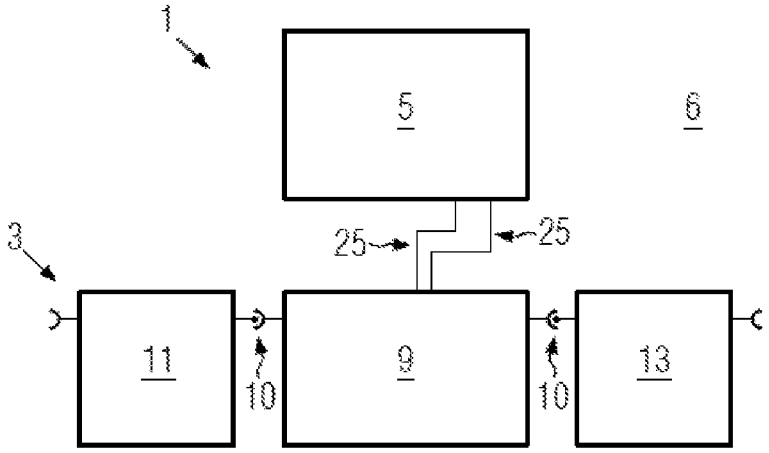
FIG. 3 shows a schematic view of an exemplified embodiment of a road paver with a heatable screed according to the disclosure in a second screed configuration comprising a basic screed and two broadening parts.

FIG. 3 shows a schematic view of an exemplified embodiment of a road paver 1 with a heatable screed 3 according to the disclosure in a second screed configuration, comprising a basic screed 9 and left and right broadening parts 11, 13. This second screed configuration serves to finish, i.e., asphalt, broader roads or areas than in FIG. 2. The broadening parts 11, 13 may be detachably arranged at the basic screed 9 as supplementary elements and may be connected with the basic screed 9 via mechanical and/or hydraulic and/or electrical connections 10. To represent the connections 10, a distance between the basic screed 9 and the broadening parts 11, 13 is shown in the drawing. The broadening parts 11, 13 are actually arranged flush at the basic screed 9 since the road pavement must be formed without any irregularities or ribs. This would occur if there were distances between the broadening parts 11, 13 and the basic screed 9. The broadening parts 11, 13 may also be telescopic elements which are arranged at the basic screed 9 and are completely or partially extensible laterally therefrom.

Figure 4:
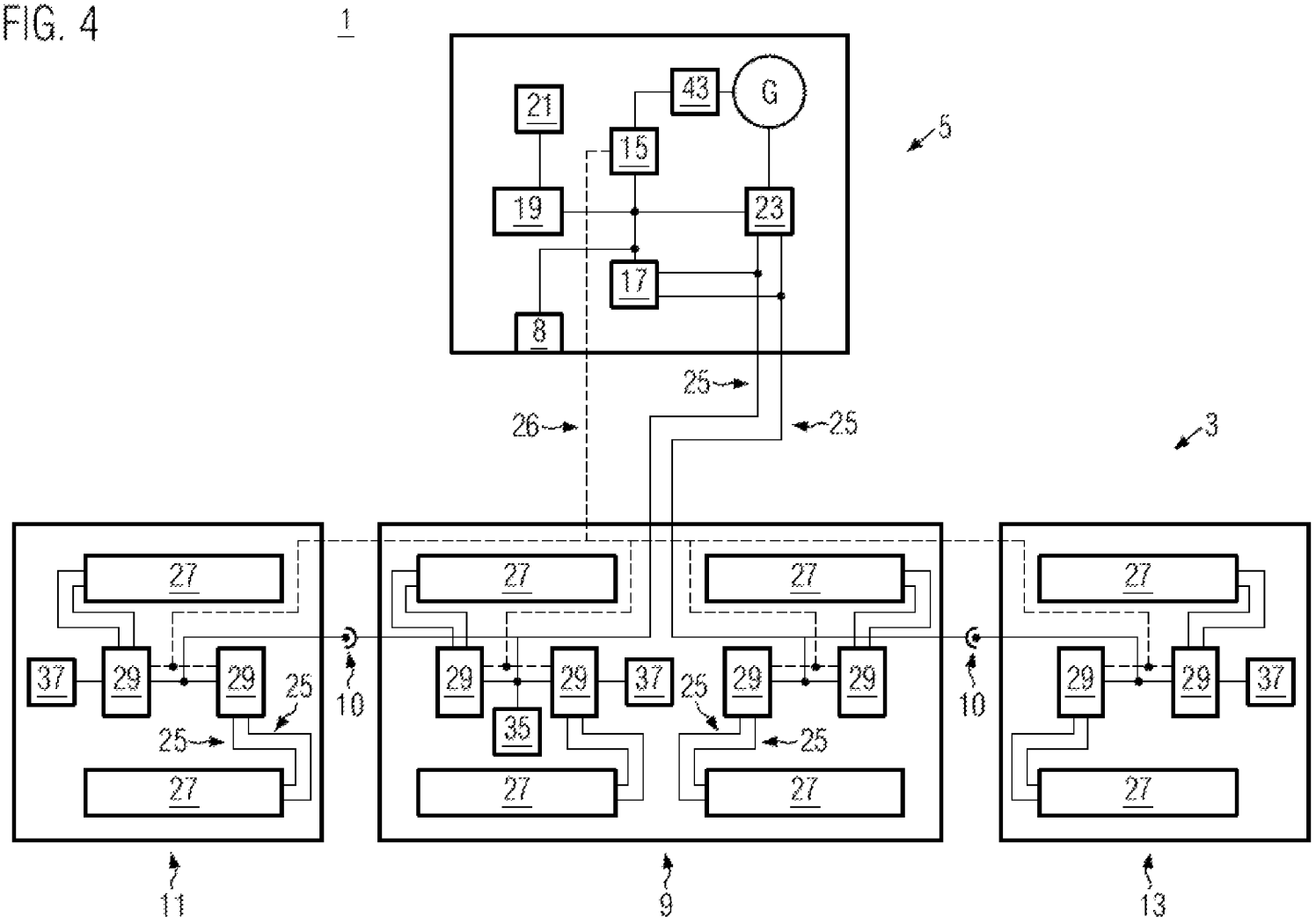
FIG. 4 shows a schematic view of an exemplified embodiment of a road paver with a heatable screed which includes a left and a right broadening part and comprises several heating elements.

FIG. 4 shows a schematic view of the components and their connection of an exemplified embodiment of a road paver 1 with a heatable screed 3. The road paver 1 comprises the tractor 5 and the screed 3 which comprises a basic screed 9 and here, by way of example, a left and a right 11, 13 broadening part. The control device 15, a Power Line Communication (PLC) base module 17, and a control panel 21, which the operator uses on the control platform of the road paver 1 to control the screed heating, are typically mounted on the tractor 5. Moreover, the tractor 5 comprises a battery 19 which provides a voltage supply of, for example, 24V and is used to start a primary drive, typically a diesel engine, or to supply the electronic components when the engine is switched off. A generator G is driven by the engine and generates the electrical power for heating the screed 3. Moreover, a contactor 23 is provided for securing the electronic components.

As is shown in the representation, the power lines 25 are used to supply the heating elements 27, and the control signals of the PLC base module 17 are coupled into the power lines 25. Here, a variation is shown in which two power lines 25 lead away from the contactor 23 and thus from the generator G to supply one half each of the screed 3 with power. If the dimensioning is suited, however, only one single power line 25, which leads from the contactor 23 on the tractor 5 to the screed 3 and is distributed to the heating elements 27 on the screed 3, is also possible. The heating elements 27 are connected to the power lines 25 via a PLC module 29. The PLC module 29 receives the signals for switching on and off the resistance wire windings of the heating elements 27 from the control device 15 or the PLC base module 17 and thereby switches a switching relay 31 (FIG. 5) for opening and closing the power supply of the respective resistance wire winding. In addition to the control panel 21, a second control panel 35 may also be present at the screed 3 to permit control directly at the screed 3.

The screed configuration may be determined by the control device 15, for example, by a weight sensor 8 which measures the weight of the screed 3 at its suspension at the tractor 5. As an alternative or in addition, an ID tag 37, which is attached each at the basic screed 9 and the broadening parts 11, 13, may be read out from the control device 15. Here, the weight sensor 8 or the ID tag 37 is connected with the control device 15 and/or the PLC base module 17 by a cable, or its data may be read out via radio communication (e.g., by RFID). The PLC module 29, too, may contain the specific information on the type and design of the screed 3, and the data record may be read out by the control device 15 or the PLC base module 17. The PLC module 29 and the ID tag 37 are here not only present on the basic screed 9, but also on broadening parts 11, 13 which are connected to the basic screed 9 via mechanical and/or hydraulic and/or electric connections 10. If no PLC technique is employed, an additional control line 26 may be arranged which connects the control device 15 with the switching relay 31 (FIG. 5) and transmits the control signal.

Furthermore, a sensor 43 may be attached to the generator G to monitor its operating state and load, e.g., by measuring the winding temperature, the speed or the output voltage.

Figure 5:
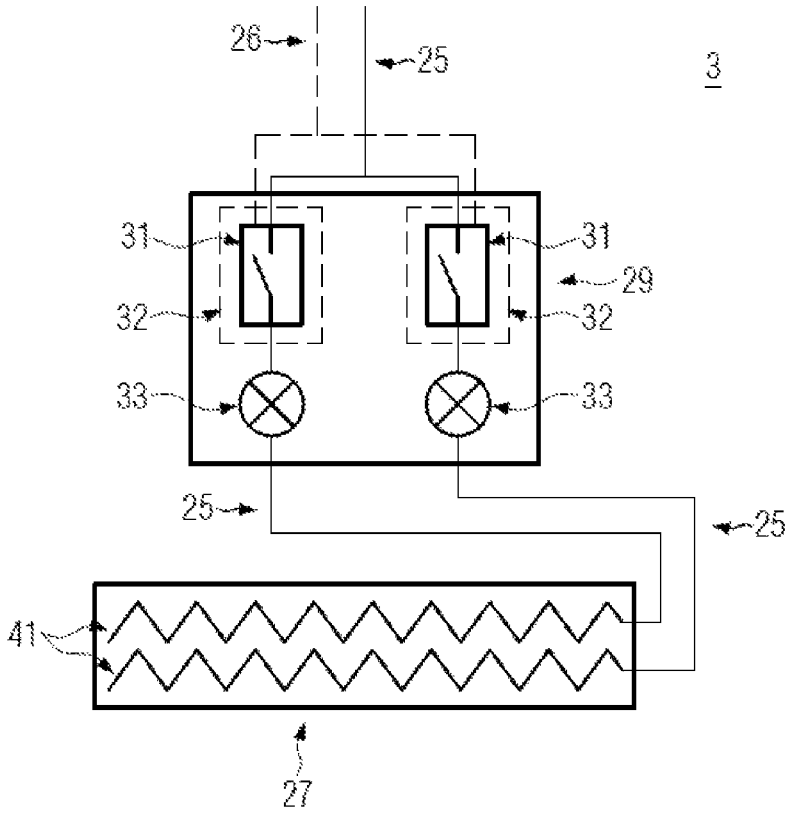
FIG. 5 shows a schematic detailed view of a PLC module and a heating element of a heatable screed.

FIG. 5 shows a detailed schematic view of a PLC module 29 and a heating element 27 of a heatable screed 3. If the heating of the screed 3 is PLC-controlled, the electric current and the control signal reach the switching relay 31 via the power line 25, the switching relay being connected to the power line 25 in such a way that due to the control signal, the switching relay 31 establishes or interrupts the current flow to the heating element 27. Each switching relay 31 switches one of, in this case, two resistance wire windings 41 of the heating element 27 and is connected with the resistance wire winding 41 by one further power line 25 each. The supply line from the generator G to the switching relay 31 or the PLC modules 29 may be effected, if the line dimensions are selected in a suitable manner, by one single power line 25 which is divided in front of the PLC modules 29 towards them. Equally, more than two power lines 25 are conceivable. The electronic circuit within the PLC modules 29 is configured to process the control signals destined for the respective PLC module 29 as is generally known from data transmission. Separate power lines 25 lead from the switching relay 31 or the PLC modules 29 to the individual resistance wire windings 41. Here, an LED light 33 may be inserted to indicate the working state of the resistance wire winding 41. Additionally, the switching relay 31 may be integrated in a heating element monitoring module 32 which provides additional functions for monitoring the screed heating. Preferably, the heating elements 27 are designed modularly, i.e., they are formed to be detachable as a module including their resistance wire windings and are dimensionally stable. The resistance wire windings 41 may be encapsulated in a heat-conducting material.

If no PLC communication is employed, an additional control line 26 may be arranged and transmit the control signal to the switching relay 31.

Figure 6:
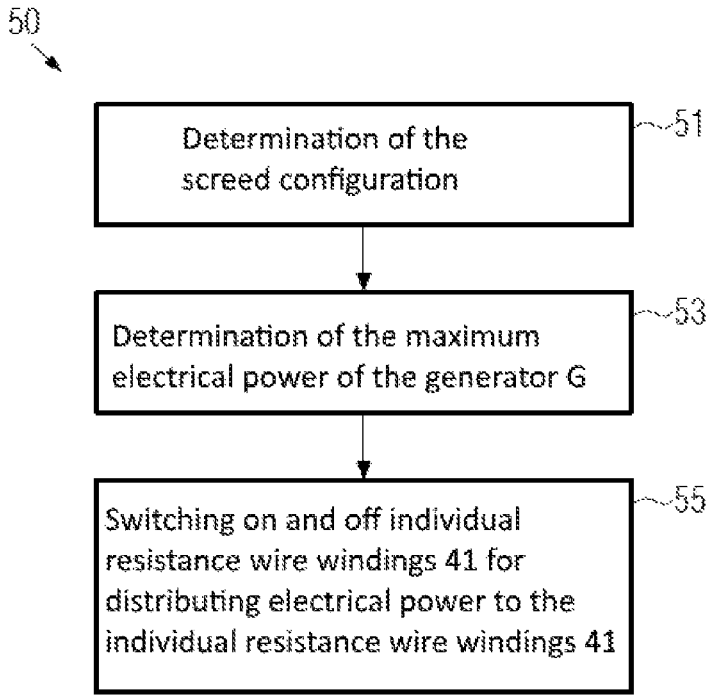
FIG. 6 shows a schematic view of the most important steps of the method, controlled by the control device.

FIG. 6 shows a schematic view of the most important steps of the method 50 for heating compacting units 7 of a screed 3, controlled by the control device 15. In step 51, the control device 15 determines the screed configuration, for example by means of the weight sensor 8. Thus, e.g., a basic screed 9 may have a known weight of 2.0 t, and two broadening parts 11, 13 of 0.8 t each. Since the weights are specific for the individual screed types, the control device 15 may determine their configurations and heating power data. As an alternative, the screed data are stored in electronic storage units, the ID tags 37, and may be read out by the control device 15. As an alternative, the screed data may also be stored in storage units of the PLC modules 29 or are entered by the operator via an interface.

Then, a further step 53 follows in which the maximally possible electrical power of the generator G is determined by the control device 15. In the process, the selection of the operating mode, e.g., "Eco" or "Power", is considered in which the maximally available power is limited by limiting, in the operating mode "Eco", the speed of the generator G to a maximum value, or by allowing, in the operating mode "Power", the technically possible maximum power of the generator G.

Subsequently, the control device 15 distributes, in step 55, electrical power generated by the generator G to the resistance wire windings 41 by switching them on or off. As was already mentioned above, one has to distinguish between a maximum electrical power available for heating the screed 3 and a maximum generator power, since the generator G typically also feeds other electric consumers with power. The switching on and off of the resistance wire windings 41 may also be done in a clocked manner, i.e., the individual resistance wire windings 41 are provided with electric energy alternatingly, according to a previously calculated switching pattern.

Starting from the above represented embodiments of a road paver 1 with a heatable screed 3, many modifications thereof are possible. For example, the screed 3 may comprise, apart from the compacting units 7, such as tampers, screed plates or pressing strips, other compacting units 7. Equally, the road paver 1 may also comprise screeds 3 of a fixed working width. The heating elements 27 may be designed differently, as required, where the resistance wire windings 41 may have different shapes and sizes. Modifications of the power and voltage supply and the control device 15 are possible in many variations. For example, the power supply may be designed in direct or alternating current technique.

What is claimed is:

1. A road paver comprising:

a generator;

a control device; and a screed comprising a basic screed that is modifiable, by selectively attaching or detaching broadening parts, from a first to at least a second, different screed configuration, the basic screed and the broadening parts each comprising a compacting unit and at least one electric heating element that can be supplied with power by the generator for heating the compacting unit, each heating element comprising at least two resistance wire windings;

wherein the control device is configured to determine a screed configuration assumed by the screed based on presence, if any, of broadening parts in addition to the basic screed, and to individually switch on or off each one of the resistance wire windings of the at least one heating element of the basic screed, depending on the screed configuration determined by the control device, to distribute electrical power generated by the generator to the individual resistance wire windings.

2. The road paver according to claim 1 wherein each of the heating elements is designed modularly and is detachably attached to a portion of the screed.

3. The road paver according to claim 1 wherein the control device is configured to individually switch on or off each one of the resistance wire windings of the broadening parts depending on the screed configuration.

4. The road paver according to claim 1 wherein the resistance wire windings of each heating element are designed to output different heating powers.

5. The road paver according to claim 1 wherein the control device is configured to automatically determine the screed configuration.

6. The road paver according to claim 1 wherein the control device is configured to detect the screed configuration by means of a weight sensor or an ID tag.

7. The road paver according to claim 1 further comprising a Power Line Communication (PLC) base module, and wherein the screed comprises one or several PLC modules, and the control device and/or the PLC base module are configured to detect design of the screed by evaluating the PLC modules by PLC.

8. The road paver according to claim 1 wherein for each resistance wire winding of the at least one heating element of the basic screed, a switching relay is provided for switching on or off the resistance wire winding.

9. The road paver according to claim 8 wherein the control device is configured to control each switching relay via a power line by means of Power Line Communication.

10. The road paver according to claim 1, wherein for each resistance wire winding of the heating elements, a switching relay integrated in a heating element monitoring module is provided for switching on or off the resistance wire winding.

11. The road paver according to claim 10 wherein the control device is configured to control each switching relay via a power line by means of Power Line Communication.

12. The road paver according to claim 10 wherein a separate power line and a separate control line are connected to each switching relay of a heating element, and the control device is configured to control the switching relay via the separate control line.

13. The road paver according to claim 1 wherein the basic screed and/or the broadening parts comprise two or more heating elements each, and wherein each of the heating elements comprises at least two resistance wire windings.

14. The road paver according to claim 1 wherein the generator is configured to be operated at variable speeds so that the power of the generator is increased with an increased speed.

15. The road paver according to claim 14 wherein, depending on the setting of an operating mode of the road paver, a maximum generator speed can be pre-set, and the resistance wire windings can be switched on and off by the control device depending on a maximally available generator power.

16. The road paver according to claim 1 wherein the control device is configured to vary heating power of the heating elements depending on a pre-set timed program or switching pattern.

17. The road paver according to claim 1 wherein the control device is configured to process signals from sensors which measure winding temperature, winding resistance, speed or voltage output and thus load of the generator, and to adapt heating power of the heating elements to prevent the generator from being overloaded.

18. A method for heating compacting units of a screed of a road paver comprising a basic screed by means of one or more electric heating elements, wherein the heating elements each comprise at least two resistance wire windings and are provided with power from a generator, and wherein a control device controls the heating of the compacting units, the method comprising:

determining, by the control device, a screed configuration assumed by the screed based on presence, if any, of broadening parts in addition to the basic screed;

determining, by the control device, a maximally possible electrical power of the generator; and switching on or off individual resistance wire windings, by the control device, depending on at least the screed configuration and pre-set parameters to distribute electrical power generated by the generator to the individual resistance wire windings.

19. The method according to claim 18 wherein the control device automatically determines the screed configuration.

20. The method according to claim 18 wherein a switching relay is assigned to one resistance wire winding of one of the one or more heating elements, and the method further comprises switching on or off the one resistance wire winding by the control device via a power line by Power Line Communication.

* * * * *